United States Patent [19]

Ochoa et al.

[11] Patent Number: 4,703,221

[45] Date of Patent: Oct. 27, 1987

[54] ELECTRIC LAMP AND METHOD OF MAKING

[76] Inventors: Carlos G. Ochoa, 7916 Bethany, El Paso, Tex. 79925; German C. Aguilar, Minerva #1321, Cd. Juarez, Chihuahua, Mexico; Arnold E. Westlund, Jr., 405 Boone Ave., Winchester, Ky. 40391

[21] Appl. No.: 853,789

[22] Filed: Apr. 18, 1986

[51] Int. Cl.[4] ..... H01J 5/50; H01J 61/06; H01K 1/50

[52] U.S. Cl. ..... 313/332; 313/331; 313/579; 313/315; 174/50.6; 174/50.64; 445/27; 29/DIG. 23

[58] Field of Search ..... 29/854, 857, DIG. 23, 29/DIG. 48, 33 M; 228/173.1, 173.2, 173.5; 313/332, 331, 335; 174/50.6, 50.64, 94 R; 219/56.1, 56.21, 56.22; 445/27, 44

[56] References Cited

U.S. PATENT DOCUMENTS

| | | | |
|---|---|---|---|
| 3,668,456 | 6/1972 | Anderson | 313/318 |
| 3,868,528 | 2/1975 | Lake et al. | 313/332 X |
| 3,991,337 | 11/1976 | Noteltiers | 313/332 X |
| 4,110,657 | 8/1978 | Sobieski | 313/332 |
| 4,370,589 | 1/1983 | De Caro et al. | 313/332 X |

*Primary Examiner*—David K. Moore
*Assistant Examiner*—Mark R. Powell

[57] ABSTRACT

An electric lamp including a glass envelope having at least one conductive foil hermetically sealed within the press-sealed end portion thereof, the foil being electrically connected at one end to a side rod support wire which projects within the envelope's bulb portion to form part of the lamp's filament structure. A sound electrical connection between the support wire and conductive foil is attained by providing the end portion of the support wire with a relatively flat configuration and knurling a surface of this flattened end. This knurled surface, being welded to the foil, provides such a connection without the use of flux or the like. A method of making this lamp is also disclosed.

9 Claims, 4 Drawing Figures

ELECTRIC LAMP AND METHOD OF MAKING

TECHNICAL FIELD

This invention relates to electric lamps having a press seal at one or both ends thereof and having a refractory metal foil embedded within the press seal. It particularly relates to the embedded connection between the foil and a filament support wire or rod.

BACKGROUND

Lamp envelopes that have high operating temperatures are commonly made of a high melting point glass having a high silica content. Such glasses can be quartz, fused silica, Vycor (a glass having approximately 96 percent silica) and the like. Such lamp envelopes are usually sealed by a press seal at one or both ends thereof. The press seal is formed by heating the open end of a tubular lamp envelope to the softening point of the glass and pressing the softened end between a pair of jaws.

Examples of lamps having press seals of the type to which this invention relates are tungsten halogen lamps. The envelopes of such lamps utilize press seals in order to prevent seal failures due either to thermal expansion of the glass or of the metal conductor embedded therein. The high operating temperature of the lamps obviates the use of stem seals, such as are generally used in incandescent and fluorescent lamps, which have much lower operating temperatures.

It is known in the art of lamp envelopes having press seals, and in particularly those lamps of the tungsten halogen variety, to employ a thin refractory metal conductive foil to establish an electrical connection between the lamp's external (outer) lead wires and the internal filament structure (or electrodes). Several electric lamps possessing such components are available on the market today. Typically, such foils are produced from thin molybdenum stock (for its ductility).

As further described below, the present invention relates particularly to the electrical connection between such a conductive foil member and the lamp's internally positioned filament structure. With greater particularity, the invention concerns the provision of a sound electrical connection between such a conductive foil member and a side rod support wire which forms part of such a filament structure. For definition purposes, the term side rod support wire is meant to include any internal conductive lead wire which projects within the lamp's envelope and is electrically coupled to and/or forms part of the lamp's filament structure. Such a wire also provides support for the filament(s) to thereby assure their proper orientation within the envelope.

Heretofore, connection between the side rod support wire (e.g., molybdenum) and conductive foil has typically involved a welding operation wherein a flux was required in order to obtain a relatively strong bond between both elements. This procedure has typically involved either utilization of a flux of substantially pure platinum, which understandably adds appreciably to the cost of the end product, or use of a less expensive flux (e.g., one consisting of platinum clad molybdenum foil or wire wherein the platinum comprised about fifteen percent by weight of the flux). This latter technique also possesses several disadvantages, however, in that it has typically required difficult to control manual operations (e.g., flux and foil orientation) as well as a double weld wherein the flux is first attached (to the side rod) and this assembly (flux and side rod) is thereafter welded to the foil. Such a double weld in the same area may cause side rod embrittlement and/or breakage. Another problem of this latter technique is that use of the heretofore cylindrical side rod results in only a single line of contact between side rod and foil, such that a weld along this location has occasionally markedly imprinted the molybdenum foil and caused it to tear. Still another problem when using a fifteen percent platinum flux has been the observation of platinum migration during welding to the outer regions of the junction, leaving between the two parts being joined a relatively thin amount of molybdenum with relatively little platinum intermixed therein. Effective weld control has thus been difficult to attain. Lastly, the aforementioned welding techniques have typically mandated relatively high current densities in order to provide a sound connection between the cylindrical support wire and flat foil. In one example, densities in excess of about 600 amperes per square millimeter have been required.

It is believed, therefore, that an electric lamp and method of making same wherein the aforementioned several disadvantages are overcome would constitute a significant advancement in the art.

DISCLOSURE OF THE INVENTION

It is, therefore, a primary object of this invention to enhance the electric lamp art by providing an electric lamp wherein the conductive foil and internal side rod support wire members thereof are effectively and soundly connected in a manner which obviates the several aforementioned disadvantages of prior such techniques.

It is another object of this invention to provide a method of making such a lamp which can be accomplished in a facile, cost-effective manner readily adaptable to mass production.

In accordance with one aspect of the invention, there is provided an electric lamp including an envelope having a bulb portion and at least one press-sealed end portion, a filament structure located within the bulb portion and having at least one side rod support wire, a thin conductive foil hermetically sealed within the press-sealed end portion and electrically connected at one end thereof to an end portion of the side rod support wire, and at least one outer lead wire extending within said press-sealed end portion and electrically connected to the conductive foil. The end portion of the side rod support wire connected to the thin conductive foil is of flattened configuration and includes a knurled surface, the foil being connected to this end portion along the knurled surface.

In accordance with another aspect of the invention, there is provided a method of making an electric lamp including an envelope having a bulb portion and at least one end portion, a filament structure including at least one side rod support wire, a thin conductive foil and at least one outer lead wire. The method includes the steps of flattening an end portion of the side rod support wire, knurling a surface of this flattened end portion, electrically connecting the resulting flattened, knurled surface to the thin conductive foil, electrically connecting the outer lead wire to the thin conductive foil, aligning the conductive foil having the side rod support wire and outer lead wire connected thereto relative to the end portion of the envelope, and press-sealing the envelope's end portion to hermetically seal the thin conductive foil therein.

BEST MODE FOR CARRYING OUT THE INVENTION

For a better understanding of the present invention together with other and further objects, advantages and capabilities thereof, reference is made to the following disclosure and appended claims in connection with the above-described drawings.

Figure 1:
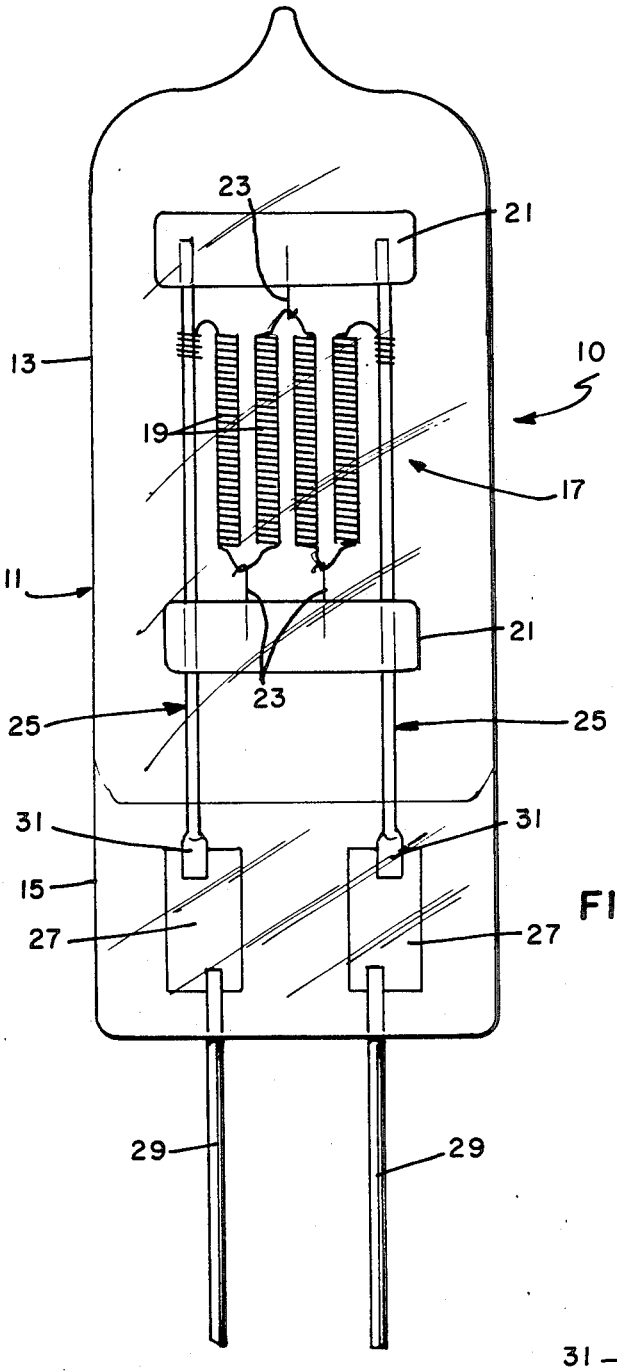
FIG. 1 is an elevational view of one embodiment of an electric lamp having the support wire and conductive foil connection as defined herein.

With particular attention to FIG. 1, there is shown an electric lamp 10 possessing a conductive foil and side rod support wire connection in accordance with the teachings of the instant invention. Lamp 10 is preferably a tungsten halogen lamp which, as is known in the art, typically includes an atmosphere within the envelope containing a halogen (e.g., bromine). Such lamps operate on a regenerative cycle initiated when a tungsten halide is produced and chemically combines with particles evaporated from the energized filament to thus prevent evaporated tungsten particles from depositing on the filament or on the internal surfaces of the envelope's wall. Although the lamp depicted in FIG. 1 is described as a tungsten halogen lamp, it is understood that the teachings of the invention are not limited thereto in that these teachings are also clearly applicable to other forms of electric lamps wherein sealed end portions having conductive foils therein are utilized. For example, the invention may also be applicable to arc discharge lamps, such as high pressure mercury vapor lamps and metal halide lamps, wherein an internal rod and foil connection is often required, the rod having a coiled tungsten electrode (filament) located thereon. Such lamps are also typically sealed at opposing ends of the envelope thereof such that each end includes the aforedescribed electrode structure.

Lamp 10 includes an envelope 11 of high melting point glass (e.g., quartz, fused silica, Vycor) having a bulb portion 13 and at least one press sealed end portion 15. Located within bulb portion 13 is the aforedescribed halogen atmosphere as well as the lamp's filament structure 17. In one example, filament structure 17 was a C-13D filament structure known in the art. Such a structure typically includes a plurality of coiled tungsten filaments 19 oriented in a substantially parallel relationship and electrically coupled in series. This structure is not meant to limit the scope of the invention, however, in that several other types of filaments (including the aforementioned electrode structure) are applicable to the teachings of this invention. Examples of other filament structures capable of being utilized in lamps of the type illustrated in FIG. 1 are shown on page 8-3 of the "IES Lighting Handbook", fourth edition, published by the Illuminating Engineering Society (New York, N.Y.), a well known reference manual in the lighting art. Description of such filament structures is provided on pages 8-1 and 8-2 of this manual.

Located at each end of the plurality of filaments 19 is a glass bridge 21 formed from a rod of quartz material. Such bridges are known in the art and serve to provide support for filament structure 17. In addition, looped support elements 23 (e.g., wire hooks) are imbedded within the glass bridges with preselected locations of the filament structure 17 suspended therefrom. Also forming part of this entire filament structure are a pair of side rod support wires 25 which each project within bulb portion 13 and pass through the lower glass bridge and into the uppermost bridge. As particularly shown in FIG. 1, the coiled filaments 19 are electrically coupled to both support wires 25 (e.g., by winding the terminal ends thereof about a respective wire). Each support wire 25 thus also provides support for the filament structure 17 in addition to providing electrical connection thereto.

As further shown in FIG. 1, each support wire 25 extends within the press seal end portion 15 of envelope 11 and is electrically coupled to a respective thin conductive foil member 27 which is hermetically sealed within end portion 15. Electrically connected to an opposite end of each conductive foil 27 is an outer lead wire 29 which projects externally from sealed end 15 and is thus designed for being electrically connected to the power source necessary to operate lamp 10. Outer leads 29 are of a sound electrically conductive material (e.g., molybdenum, tungsten). Each of the side rod support wires 25 are preferably of molybdenum and possess an original, substantially cylindrical configuration having a diameter of about 0.025 inch. As described herein, the instant invention involves the modification of this original configuration at the end portion thereof in order to provide a more effective and sound electrical connection between the support wire and the respective molybdenum conductive foil located within the lamp's press sealed end portion 15.

Figure 2:
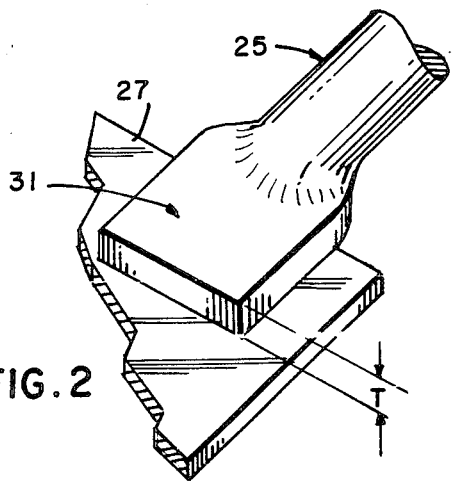
FIG. 2 is an enlarged, partial perspective view of the connection as used in the lamp of FIG. 1.

As shown in FIG. 2, this modification involves the formation of a flattened and knurled end portion 31 at the end of the support wire which is electrically connected to the thin molybdenum foil 27. Formation of this end portion in the manner taught herein provides for not only greater surface contact between these two elements but also for a more effective connection therebetween. As also described herein, this effective connection is attained without utilization of welding flux or alike. Although it is depicted in FIG. 1 that the ends of both support wires 25 are formed in accordance with the teachings herein, it is understood that the invention is not limited in this respect in that only one such wire need be so formed.

Figure 3:
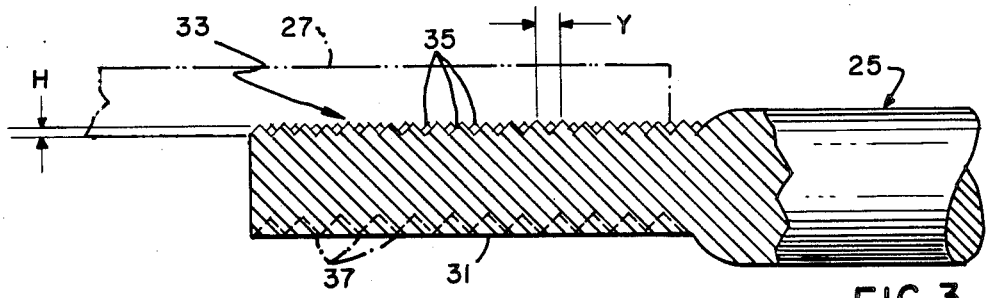
FIGS. 3 and 4 represent substantially enlarged, partial side and top views, respectively, of the flattened and knurled end surface of the invention's support wire in accordance with a preferred embodiment thereof.
Figure 4:
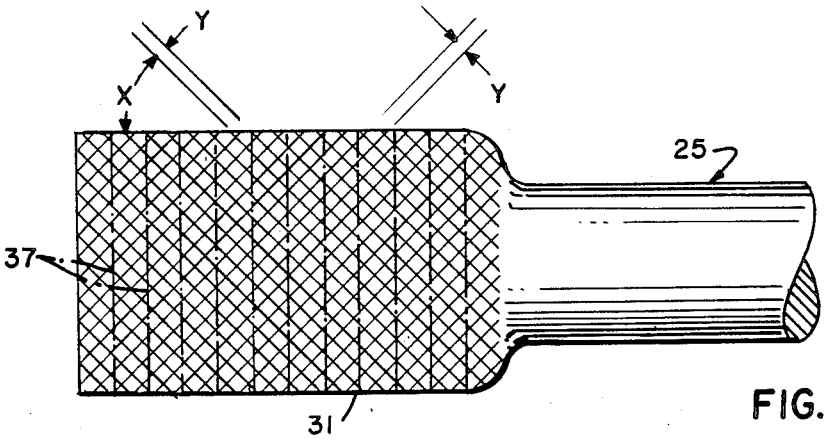

In FIG. 2, one of the described support wires 25 is shown as including the aforementioned flattened and knurled end portion 31, which end portion has been welded to a corresponding flat surface of foil 27. The knurled surface, illustrated in FIGS. 3 and 4, is understood to be that surface engaging foil 27. Preferably, end portion 31 is formed by swagging this part of the cylindrical wire to approximately 70 to about 80 percent of its original diameter. That is, the flattened end will have a thickness T of within the range of about 70 to about 80 percent of the original diameter (e.g., 0.025 inch). In a specific example wherein a support wire having such an original diameter was utilized, this flattened end was electrically connected to a thin molybdenum foil having a thickness of about 0.0013 inch. Using resistance welding to secure these components, a weld penetration into the molybdenum foil of about 0.0004 inch was observed. The preferred method of welding to achieve this connection was resistance welding wherein the foil and support wire assembly was pressed between a pair of resistance welding electrodes and sufficient electrical current passed therethrough to heat and tack the two elements. Current densities within the range of only from about 100 amperes per square millimeter to about 175 amperes per square millimeter were possible using the teachings of the instant invention. After this connection was provided, the assembled filament structure was inserted within the hollow glass tubing which eventually formed envelope 11. Prior to such orientation, however, it is preferred to attach (e.g., weld) the outer leads 29 to the respective ends of the molybdenum foil. It is understood, however, that this attachment may be accomplished prior to the aforementioned connection between the support wire and foil members. In either event, the assembled structure is inserted within the aforementioned glass tubing such that the foil will be aligned with the respective portion of the glass tubing which will eventually constitute the press sealed end 15. The glass tubing at this portion is then heated and a pair of clamping jaws are activated to compress the heated glass and hermetically seal the molybdenum foil (and end segments of the support wires 25 and outer leads 29) therein. Subsequently, the remaining portion of the glass tubing which eventually will comprise the bulb portion 13 is subjected to various evacuation and flushing procedures afterwhich the aforementioned halogen atmosphere is injected therein. Subsequently, the opposing end of envelope 11 is sealed to provide the protruding tip illustrated in FIG. 1. These latter described techniques, including formation of such a tip, are well known in the art and further description is not believed necessary. It is also understood that the aforementioned press sealing operation is also a well established technique and further description is also not believed necessary in this regard.

FIGS. 3 and 4 represent much enlarged views of the preferred end portion 31 as formed within the originally cylindrical support wire 25. As shown in FIG. 3, this flattened (swaged) end includes the aforementioned knurled surface therein, this surface including a plurality of spaced-apart upstanding projections 35. These projections, as shown in FIG. 3, are of substantially uniform height and are preferably located within end portion 31 in a predetermined pattern. This pattern, as shown in FIG. 4, is of substantially diamond configuration. The diagonal lines as utilized in FIG. 4 represent the orientations for the peaks of these projections such that each of the respective intersections between these diagonal lines will constitute one of these peaks. In accordance with the teachings herein, the upstanding projections formed within end 31 are spaced apart a minimum distance Y of from about 0.010 inch to about 0.020 inch. That is, the respective peaks of these projections are so spaced. This projection density, when utilizing a support wire and molybdenum foil possessing the aforementioned dimensions, was deemed ideal to attain the desired weld penetration upon application of the aforementioned electrical current at the current densities stipulated above. It was also determined that under such constraints, spacing of these projections at substantially greater distances (e.g., 0.030 inch) resulted in an occasional tearing of the thin molybdenum foil as a result of the described welding operation.

As stated, the projections formed within end portion 31 using the described knurling operation form a substantially diamond-shaped pattern such that the peaks are aligned at a predetermined angle X relative to the planar outer edges of the end portion. In a preferred example, this angle was about 45 degrees. The molybdenum foil 21 is illustrated in phantom in FIG. 3 but not shown in FIG. 4 for illustration purposes.

Formation of end portion 31 is preferably accomplished by positioning the cylindrical wire 25 between two opposed cylinders which freely rotate on bearings. The upper cylinder preferably includes a knurled forming surface and is activated by a lever arm. The lower bearing (and cylinder) is fixed such that activation of the described lever arm results in compression of the wire to form end portion 31. Thus, both swaging and knurling of wire 25 is accomplished simultaneously and in a relatively simple fashion.

As even further seen in FIGS. 3 and 4, end portion 31 may also include a plurality of parallel ridges or grooves 37 (phantom) formed therein (e.g., during the aforementioned knurling of the opposite surface). These indentations, in one example totalling from about 5 to about 7 in number and each occupying a depth of about 0.004 to about 0.007 inch within the flattened end's lower surface, function to prevent slippage of the side rod support wire 25 in the heated glass of envelope 11 during the aforedescribed press sealing of end 15. These indentations are parallel to the upper edge of the molybdenum foil and also to the outermost edge of end portion 31.

Using the aforementioned fluxless technique of the instant invention, increased penetration between the two mating surfaces of the support wire and molybdenum foil has been observed, resulting in a bond therebetween stronger than that obtained between two pairs welded using the traditional flux method but without modification to the part geometries. It is believed that this enhanced connection between the support wire and molybdenum foil is the result of providing uniformly spaced projections so as to in turn provide several spaced points of contact along the foil's mating surface and thus enable electric current to pass through each of these contact points simultaneously during application of the aforementioned electrical current by the resistance welding electrodes. In effect, a homogeneous blending between the two members occurs as a result of a substantially uniform alteration of material at this location. Cost reduction to the lamps being produced in accordance with the teachings of the instant invention has been realized by virtue of flux elimination and a corresponding shrinkage reduction.

While there have been shown and described what are at present considered the preferred embodiments of the invention, it will be obvious to those skilled in the art that various changes and modifications may be made therein without departing from the scope of the invention as defined by the appended claims.

What is claimed is:

1. In an electric lamp including an envelope having a bulb portion and at least one press-sealed end portion, a filament structure located within said bulb portion and having at least one side rod support wire, a thin conductive foil hermetically sealed within said press-sealed end portion and electrically connected at one end thereof to an end portion of said side rod support wire, and at least one outer lead wire extending within said press-sealed end portion and electrically connected to said conductive foil, the improvement wherein said end portion of said side rod support wire is welded to said thin conductive foil and is of flattened configuration including a knurled surface having a plurality of spaced-apart, upstanding peaked projections of substantially uniform height located on said surface in a predetermined pattern, said foil being welded to said flattened, knurled end portion of said side rod support wire along said knurled surface and without the use of welding flux.

2. The electric lamp according to claim 1 wherein said welding used to provide said electrical connection between said side rod support wire and said conductive foil is resistance welding.

3. The electric lamp according to claim 1 wherein said side rod support wire and said thin conductive foil are each comprised of molybdenum.

4. The electric lamp according to claim 1 wherein said peaked projections are located on said surface in a substantially diamond-shaped pattern.

5. The electric lamp according to claim 4 wherein each of said projections are spaced apart at a uniform spacing from the nearest, adjacent projection, said uniform spacing within the range of from about 0.010 inch to about 0.020 inch.

6. The electric lamp according to claim 4 further including a plurality of indentations formed within a surface of said flattened and knurled end portion opposite said surface having said upstanding projections therein.

7. A method of making an electric lamp including an envelope having a bulb portion and at least one end portion, a filament structure including at least one side rod support wire, a thin conductive foil and at least one outer lead wire, said method comprising:

flattening an end portion of said side rod support wire;

knurling a surface of said flattened end portion to provide a plurality of spaced-apart, upstanding peaked projections of substantially uniform height within said surface in accordance with a predetermined pattern;

welding said flattened, knurled surface to said thin conductive foil without the use of welding flux;

electrically connecting said outer lead wire to said thin conductive foil;

aligning said conductive foil having said side rod support wire and said outer lead wire connected thereto relative to said end portion of said envelope; and press-sealing said end portion to hermetically seal said thin conductive foil therein.

8. The method according to claim 7 wherein said welding is resistance welding.

9. The method according to claim 8 wherein the current density used to accomplish said resistance welding is within the range of from about 1000 amperes per square millimeter to about 175 amperes per square millimeters.

* * * * *